US006681504B2

(12) United States Patent
Kinan

(10) Patent No.: US 6,681,504 B2
(45) Date of Patent: Jan. 27, 2004

(54) CHAMELEON FOOTWEAR

(76) Inventor: Albert J. Kinan, 74 Saco Ave., Old Orchard Beach, ME (US) 04064

( * ) Notice: Subject to any disclaimer, the term of this patent is extended or adjusted under 35 U.S.C. 154(b) by 0 days.

(21) Appl. No.: 10/246,191

(22) Filed: Sep. 18, 2002

(65) Prior Publication Data

US 2003/0188457 A1 Oct. 9, 2003

Related U.S. Application Data

(60) Provisional application No. 60/371,102, filed on Apr. 9, 2002.

(51) Int. Cl.[7] ..... A43B 3/30
(52) U.S. Cl. ..... 36/112; 36/137; 36/139
(58) Field of Search ..... 36/112, 137, 139; 446/308, 337, 26, 320, 321

(56) References Cited

U.S. PATENT DOCUMENTS

| | | | | | |
|---|---|---|---|---|---|
| 3,023,420 A | * | 3/1962 | Larkfeldt et al. | ..... | 36/112 |
| 3,226,849 A | * | 1/1966 | Rosen | ..... | 36/112 |
| 4,324,054 A | * | 4/1982 | Rovinsky | ..... | 36/137 |
| 5,391,106 A | * | 2/1995 | Lidert, Jr. | ..... | 446/337 |
| 5,649,376 A | * | 7/1997 | Lecates, Jr. | ..... | 36/137 |
| 6,293,032 B1 | * | 9/2001 | Waits | ..... | 36/137 |

FOREIGN PATENT DOCUMENTS

| | | | |
|---|---|---|---|
| DE | 478711 | * | 7/1929 |
| GB | 2243759 | * | 11/1991 |
| GB | 2263386 | * | 7/1993 |

* cited by examiner

*Primary Examiner*—Ted Kavanaugh
(74) *Attorney, Agent, or Firm*—William F. Hamrock, P.A.

(57) ABSTRACT

A footwear the entire appearance simulates the appearance of a reptile preferably a chameleon reptile. The footwear can be a slipper, preferably a children's slipper, having a stuffed body adapted to simulate the appearance of //a// the chameleon reptile. The outer surface of the slipper body is covered with a green skin simulating imbricating reptile plates having an open protruding reptile mouth embracing a retractable tongue. An inner horizontal air pad sole cushions the child's foot and controls the expansion and deflating of the reptile tongue and activates a foot switch of a battery powered electric system which controls a pair of opposing reflector eye lamps.

12 Claims, 3 Drawing Sheets

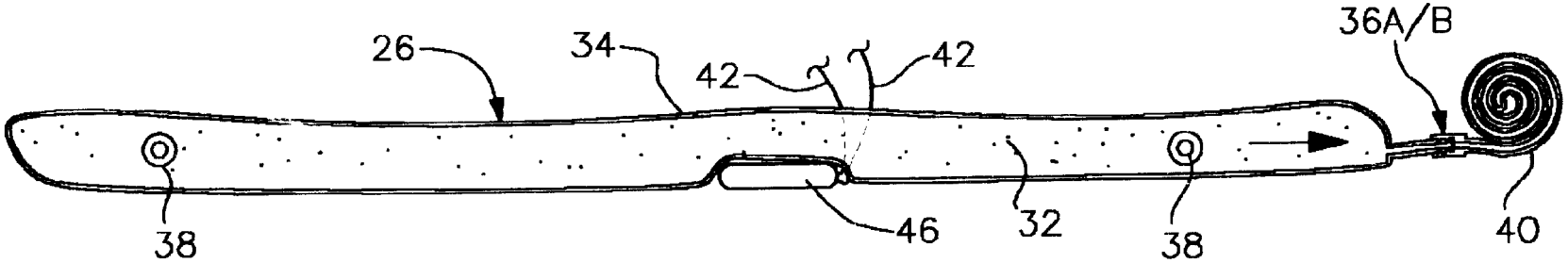
Fig. 3A
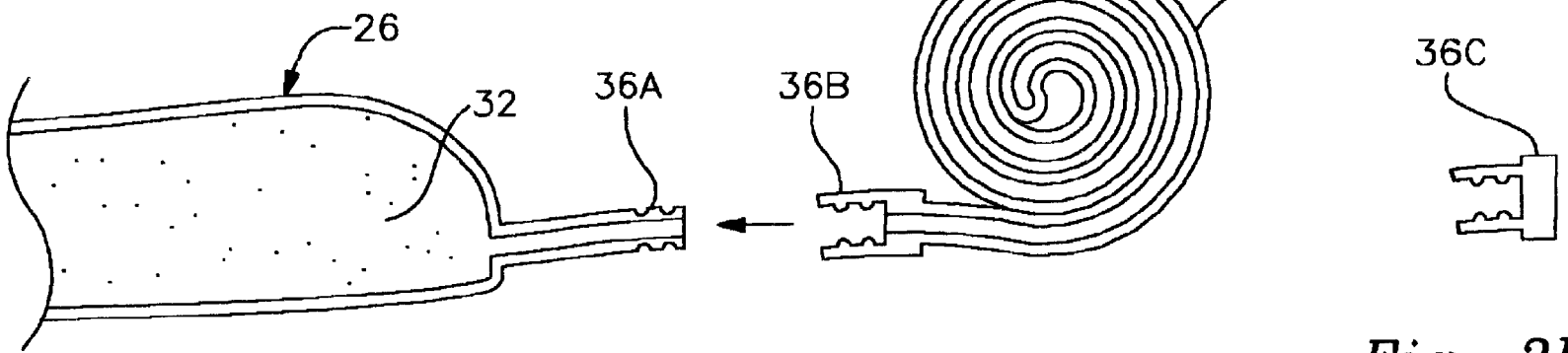
Fig. 3D
Fig. 3C
Fig. 3B

CHAMELEON FOOTWEAR

Applicant's Provisional Patent Application, Ser. No. 60/371,102, for Chameleon Footwear was filed on Apr. 9, 2002.

BACKGROUND OF THE INVENTION

The invention relates in general to footwear, and more particularly, to footwear simulating the appearance of a reptile, preferably a chameleon reptile, and even more particular to an interior sole cushioned slipper in the form of a chameleon which provides a universal air pad interior sole, illuminated reflector eye lamps, a retractable tongue and smooth green outer skin simulating reptile plates.

There are a large number of children's books describing and telling stories about numerous types of animals. In many instances, these descriptions and stories are remembered and cherished by the readers for an entire lifetime and are often passed along to their children and grandchildren. I have written such a children's book describing the life and adventures of a chameleon which is a lizard reptile generally located in warm weather climates such as in the southern United States and elsewhere in the world. In keeping with the gist of my chameleon story, I have invented a slipper, preferably a children's cushioned slipper, which is designed and configured to represent the chameleon as depicted in my story.

There are a number of footwear articles such as slippers, sneakers, shoes and sandals described in prior patents which simulate the appearance of an animal and/or emit illumination and/or emit sounds from the footwear.

By way of example, U.S. Pat. No. 3,023,420 to Tann describes a slipper sock having a puppet mounted on the toe.

U.S. Pat. No. 4,848,009 to Rodgers discloses flashing footwear.

U.S. Pat. No. 5,052,131 to Rondini discloses strapped footwear with decorative lighting.

U.S. Pat. No. 5,649,376 to Lecates discloses a sneaker to simulate the sight and sound of a snake.

U.S. Pat. No. 5,930,921 to Sorofman et al. disclse illuminated sneakers.

U.S. Des. #378,009 to Sullivan et al. disclose lizard strap thong sandal.

U.K. Patent Application G.B. #2,263,386 discloses footwear having an electrical generating device for audible or light signal.

My footwear in accordance with the present invention substantially departs from the conventional concepts and designs of all prior footwear, to the best of my knowledge, since there are no known footwear items directed to the entire appearance of a lizard or reptile, and especially to a chameleon reptile. Thus, my new and improved slipper, as opposed to all previous footwear, provides a universal air pad cushioned slipper having green outer skin simulating imbrecating reptile plates in the form of a chameleon reptile which is comfortable to wear, provides projected illumination and retractable tongue capable of providing a hissing sound to simulate the sight and sound of a chameleon reptile as well as enhance the safety of children wearing the slippers particularly in the darkness when there whereabouts and safety is a concern for there parents.

SUMMARY OF THE INVENTION

The present invention overcomes many of the deficiencies of prior art footwear and slippers, and in particular children's footwear and slippers, resembling animals and the like. Accordingly, the present invention provides a stuffed slipper representing a chameleon reptile having green colored outer skin simulating retile plates and an open mouth. The present slipper has a cushioned air pad upper sole embracing the inner sole having an arch support for improved comfort for the wearer. The air pad controls the the expelling and hissing of retractable tongue. A battery operated electrical system controls the illumination of eye lamps

BRIEF DESCRIPTION OF THE DRAWINGS

The invention is described by appended claims in relation to the description of preferred embodiments with reference to the following drawings which are described briefly as follows:

FIGS. 3A, B, C and D depict a side view of the universal air pad and attachments to the retractable tongue.

DESCRIPTION OF THE PREFERRED EMBODIMENTS

Terms used to describe features of the invention are listed below with numbering in the order of their initial use with reference to the drawings. These terms and the numbers assigned to them designate the same features wherever used throughout the description.

Figure 1:
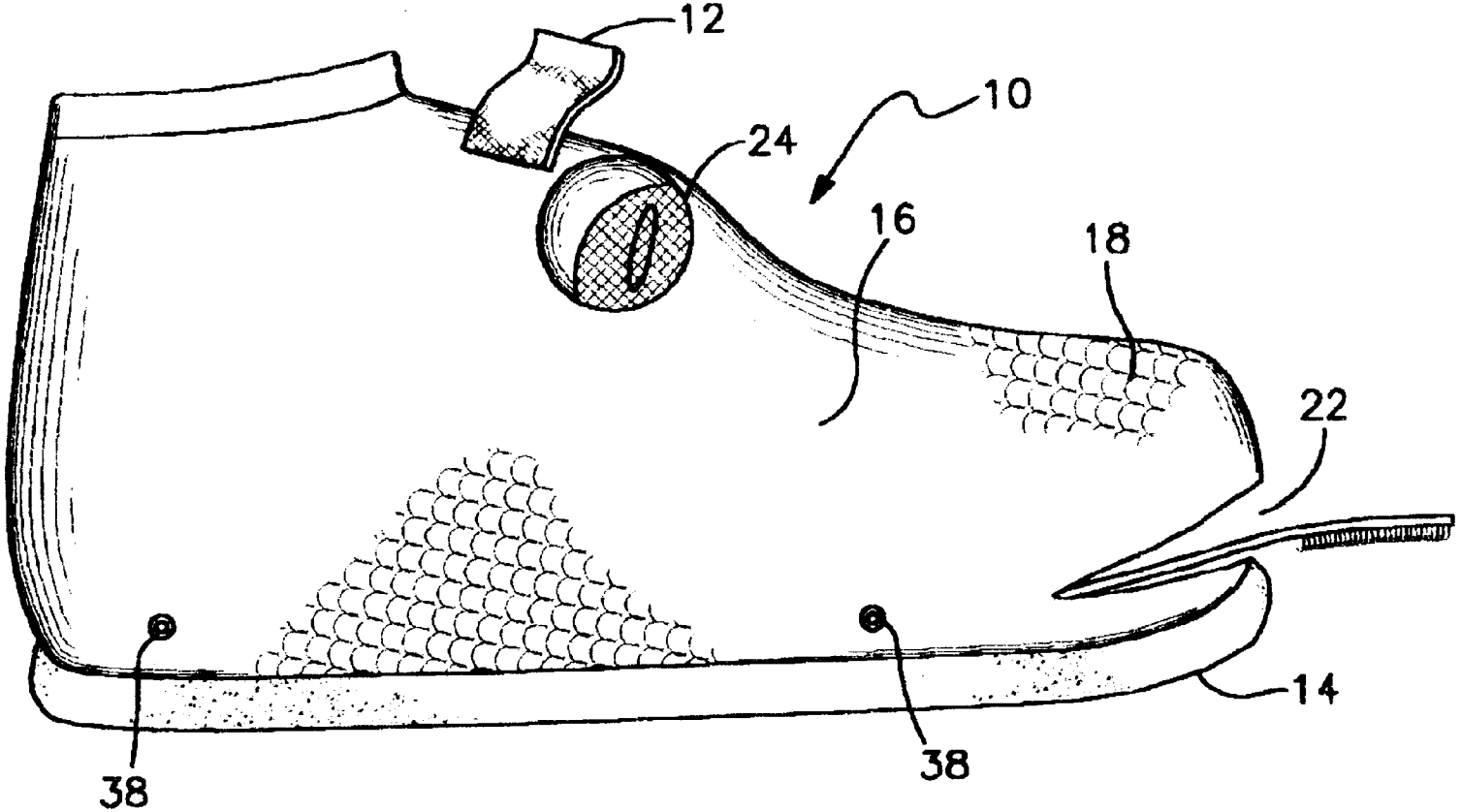
FIG. 1 is a perspective overall view of the preferred embodiment of the invention showing the chameleon slipper.

Referring now to the drawings, FIG. 1 is an illustrative view of the chameleon slipper of the present invention. Slipper 10 comprises an overall stuffed body and outer sole 14. The body is configured in the form of a chameleon having a green colored smooth outer skin 16 simulating imbricated plates 18, distinctive of a reptile, with appropriate stuffing to enhance the reptile appearance. An open protruding simulating reptile mouth 22 forms the front portion of the body with a pair of opposing aluminum concave reflector eye lamps 24 positioned in the top area above the mouth.

Figure 2:
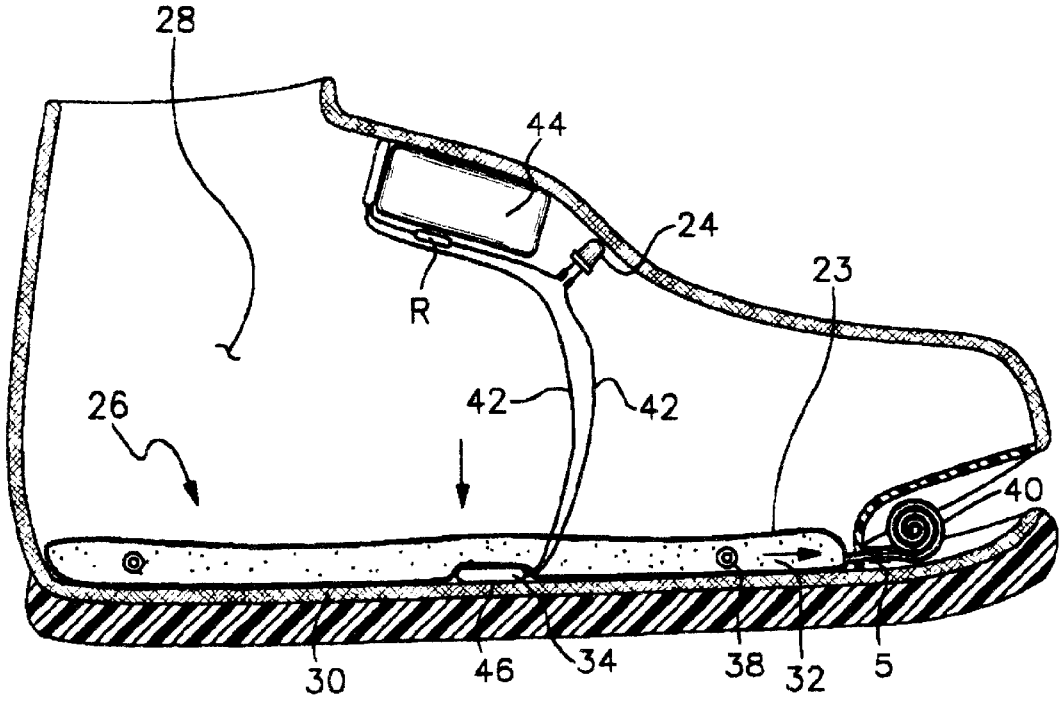
FIG. 2 is a partly cut away perspective side view of a preferred embodiment showing the inner sole, the retractable tung, the illuminating eye lamps and the electrical system.

The interior of the stuffed slipper, as seen in the cut away sections in FIG. 2, comprises the front enclosed toe portion 24, the rear heel portion 26 and ankle portion 28 extending upwardly and enclosing the entire foot and ankle area of the wearer. Embracing the interior sole 30 is universal air pad upper sole 32 fitted to embrace the entire interior slipper toe portion 24 and heel portion 26. Universal air pad upper sole 32, as depicted in FIG. 3A, can be fabricated from strong resilient plastic or rubber material filled with air and configured to comfortably fit the foot of the wearer including arch support 34 for improved foot support. The front area of the air pad includes tubular extension plug valve 36A which controls the expelling of air from the toe portion of the air pad adjacent to the rear the of the chameleon's open mouth to be discussed. A pair of opposing air release valves 38 on opposite sides of the air pad controls the release of air when excessive weight from a bulky wearer is applied to the air pad.

In a preferred embodiment of the invention, as shown in FIGS. 3A, B, C and D retractable tongue 40 made of a rolled, flexible, expandable plastic tubing is releasably secured to extension plug system 36A and B through the rear of mouth 22 By means of this construction, with the toes of the wearer positioned in the enclosed toe portion of the slipper, air from the air pad is forced through extension plug connectors 36A and B into the retractable tongue by pressing down on the toe area of the air pad. Thus, as the wearer is in the walking gate, the retractable tongue is filled with air and expanded, being forced out through the chameleon's mouth which is capable of causing a hissing sound. The stopper 32C is used to plug extension plug connector 36A when connector 36B and the retractable tongue are disconnected.

In a further preferred embodiment of the invention, battery powered electrical system 42 powers a pair of opposing eye lamps 24 to illuminate the way for the wearer to see in darkness. The eye lamps are centrally positioned above open mouth 22 to simulate the eyes of a chameleon. In the electrical system, a 1.9 volt battery 44 is releasably positioned under removable strip 12 to the rear of eye lamps 24 as the source of power for activating light emitting diodes (LED's) located in the eye lamps. The negative side of the battery is wired to both LED's negative leads. The positive side of the battery to one side of a normally open, momentary foot switch 46 located beneath air pad 32, the opposite side of the foot switch is wired to both LED's positive leads. When foot switch 46 is open the LED's will not illuminate, when foot switch 46 is closed the LED's will illuminate the eye lamps 24.

Figure 4:
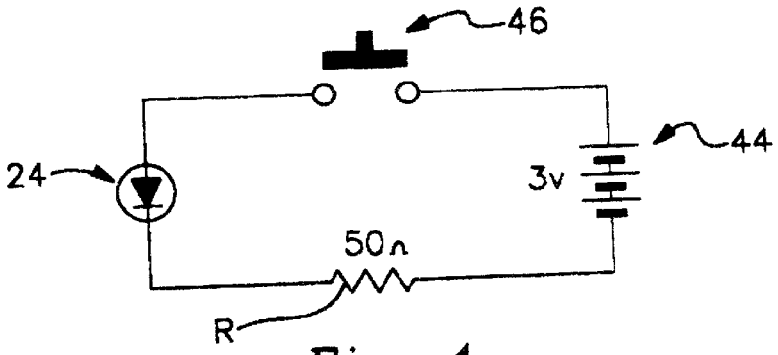
FIG. 4 is a line diagram of the electrical system of the invention.

Foot switch 46 is activated when pressure is applied to the air pad. When the heel of the wearer in the walking gate applies heel pressure to foot switch 46, the foot switch will close and activate LED's in eye lamps 24 to assist in lighting the way in the darkness in front of the wearer. FIG. 4 is a schematic presentation of a line diagram of the electrical system.

Thus, it will be appreciated as a result of the present invention, a highly effective, comfortable and safe slipper adapted to simulate the appearance of a chameleon reptile are completely fulfilled. It is to be understood, however, that modifications and/or changes may be made in the disclosed embodiments without departure from the present invention. Accordingly, it is to be expressly understood that the foregoing description and accompanying drawings are representative of preferred embodiments only, not limiting, and that the true spirit and scope of the present invention are to be determined by reference to the appended claims.

What is claimed is:

1. A cushioned slipper having a stuffed body attached to a horizontal sole providing interior and exterior surfaces comprising, said slipper adapted to simulate the appearance of a chameleon reptile by providing green colored outer skin body layer simulating imbricating reptile plates covering the exterior stuffed body providing a protruding open reptile mouth embracing a retractable tongue, and providing a pair of opposing eye lamps, an inner toe portion, heel portion and ankle portion, an inner horizontal air pad configured to fit within the inner sole area to engage the toe portion and heel portion to cushion the foot of the wearer and to activate the retractable tongue, an electrical system to operate the eye lamps.

2. The slipper in accordance with claim 1 wherein said air pad provides an extension plug controlling the emission of air into the tongue.

3. The slipper in accordance with claim 2 wherein pressure on the air pad forces air into and expands the retractable tongue.

4. The slipper in accordance with claim 2 wherein the tongue is releasably mounted to the extension plug valve.

5. The slipper in accordance with claim 2 wherein said extension plug valve provides a hissing sound.

6. The slipper in accordance with claim 1 wherein said air pad provides opposing air relief valves on its sides.

7. The slipper in accordance with claim 6 wherein said air relief valves controls the release of air from the air pad.

8. The slipper in accordance to claim 1 wherein said eye lamps are housed in concave reflectors.

9. The slipper in accordance with claim 8 wherein the concave reflectors are housed in an oval shaped retainer.

10. A slipper in accordance with claim 9 wherein the electrical system comprises a battery for powering a foot switch to activate light emitting diodes in the eye lamps.

11. The slipper in accordance with claim 10 wherein a foot switch is located beneath the air pad activated by pressure of the foot on the foot pad.

12. The slipper in accordance with claim 1 is a children's slipper.

* * * * *